US006424155B1

(12) United States Patent
Puettmann et al.

(10) Patent No.: US 6,424,155 B1
(45) **Date of Patent: *Jul. 23, 2002**

(54) IGNITING SYSTEM WITH A DEVICE FOR MEASURING THE ION CURRENT

(75) Inventors: Lothar Puettmann, Weissach; Walter Gollin, Sachsenheim; Bernhard Eisele, Ditzingen; Markus Ketterer, Stuttgart; Hubert Bischof, Vaihingen/Enz, all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/319,060

(22) PCT Filed: Sep. 26, 1997

(86) PCT No.: PCT/DE97/02198

§ 371 (c)(1),
(2), (4) Date: Aug. 2, 1999

(87) PCT Pub. No.: WO98/23859

PCT Pub. Date: Jun. 4, 1998

(30) Foreign Application Priority Data

Nov. 28, 1996 (DE) ..... 196 49 278

(51) Int. Cl.[7] ..... F02P 17/00

(52) U.S. Cl. ..... 324/388; 324/393; 324/397

(58) Field of Search ..... 324/388, 397, 324/393, 122, 396, 398; 73/861.16; 123/651, 604

(56) References Cited

U.S. PATENT DOCUMENTS

| | | | | | |
|---|---|---|---|---|---|
| 4,218,915 | A | * | 8/1980 | Torimaru | 73/861.16 |
| 4,738,239 | A | * | 4/1988 | Haines et al. | 123/651 |
| 5,056,496 | A | * | 10/1991 | Morino et al. | 123/604 |
| 5,821,754 | A | * | 10/1998 | Puettmann et al. | 324/388 |

FOREIGN PATENT DOCUMENTS

| | | |
|---|---|---|
| EP | 0 674 103 | 9/1995 |
| JP | 04 134 181 | 5/1992 |
| WO | WO 96 31695 | 10/1996 |

* cited by examiner

*Primary Examiner*—Michael J. Sherry
*Assistant Examiner*—Paresh Patel
(74) *Attorney, Agent, or Firm*—Kenyon & Kenyon

(57) ABSTRACT

An inductive ignition apparatus for a combustion engine includes a measurement device for ascertaining the ionization current at the spark plug of each cylinder, and includes for each spark plug an ignition coil device which forms the ignition high voltage, operates on the transformer principle, and has a primary and a secondary winding, and through whose secondary winding the ionization current flows. A switch is provided which short-circuits the primary winding for the duration of the ionization current measurement.

5 Claims, 2 Drawing Sheets

IGNITING SYSTEM WITH A DEVICE FOR MEASURING THE ION CURRENT

FIELD OF THE INVENTION

The present invention relates to an inductive ignition apparatus for a combustion engine, having a measurement device for ascertaining the ionization current at the spark plug of each cylinder, and having for each spark plug an ignition coil device which forms the ignition high voltage, operates on the transformer principle, and has a primary and a secondary winding, and through whose secondary winding the ionization current flows.

BACKGROUND INFORMATION

Accurate diagnostic systems which allow conclusions to be drawn as to the combustion process are necessary in order to operate combustion engines at high efficiency and to meet stringent requirements in the area of on-board diagnosis. These diagnostic systems should moreover preferably be economical. Conventional diagnostic systems take important information about the progress of combustion directly from the combustion chamber of a combustion engine (internal combustion engine). This is done by so-called ionization current measurement, in which during a combustion cycle, the spark plug first performs its actual task, i.e., igniting the combustion mixture, and is then used for a further function by being utilized as a sensor with which the ionization current is measured. This is advantageous because no space is needed in the combustion chamber for additional sensors. Ionization current measurement is based on the principle that ions are produced during the combustion of the fuel-air mixture. This ionization is the result of a variety of mechanisms which influence the typical profile of the ionization current and therefore provide information regarding specific parameters of the combustion process, etc. When a voltage is applied to the electrodes of the spark plug for ionization current measurement, electrons and ions present in the combustion chamber are moved in the corresponding direction of the electric field, thus creating a current which is carried by these charge carriers. This current represents the aforementioned ionization current. When the ionization current measurement method, method is used with an inductive ignition apparatus which has an ignition coil device that operates according to the transformer principle and has a primary winding and a secondary winding, there exists, because of the relatively high secondary inductivity, the disadvantage that the spark duration of the spark plug is difficult to control; this can impede the measurement. In addition, because of the relatively high secondary inductivity in the ionization current path, it is possible to transfer only relatively low frequencies which, for example, are not sufficient for reliable knock detection.

SUMMARY OF THE INVENTION

The ignition apparatus according to the present invention has an advantage that as a result of a switch which short-circuits the primary winding of the ignition coil device for the duration of the ionization current measurement, the residual energy in the magnetic circuit of the ignition coil is dissipated on the primary side, i.e., is converted into heat energy and in that respect no longer drives the ignition spark, so that the latter is extinguished very quickly and reproducibly at the desired time. Short-circuiting of the primary side of the ignition coil device moreover shifts the limit frequency of the secondary side of the ignition coil considerably upward, so that any knock vibrations of the combustion engine that might occur can be observed in undamped fashion as an undesirable operating state, since the knock vibrations do not entail significant ionization current profiles.

It is particularly advantageous if the switch path of the switch has very low resistance in the closed state. The primary circuit of the ignition coil device thus has a much lower resistance than the secondary circuit, so that the ignition spark is quickly extinguished.

In particular, the switch can be configured as a field-effect transistor (FET) which possesses a low-resistance switch path at low flux voltages.

Lastly, it is advantageous if the measurement device has a control device which closes the switch preferably periodically at the desired spark termination, at least for the duration of the entire ionization current measurement. In the case of a field-effect transistor, this is accomplished by activating it accordingly.

DETAILED DESCRIPTION

Figure 1:
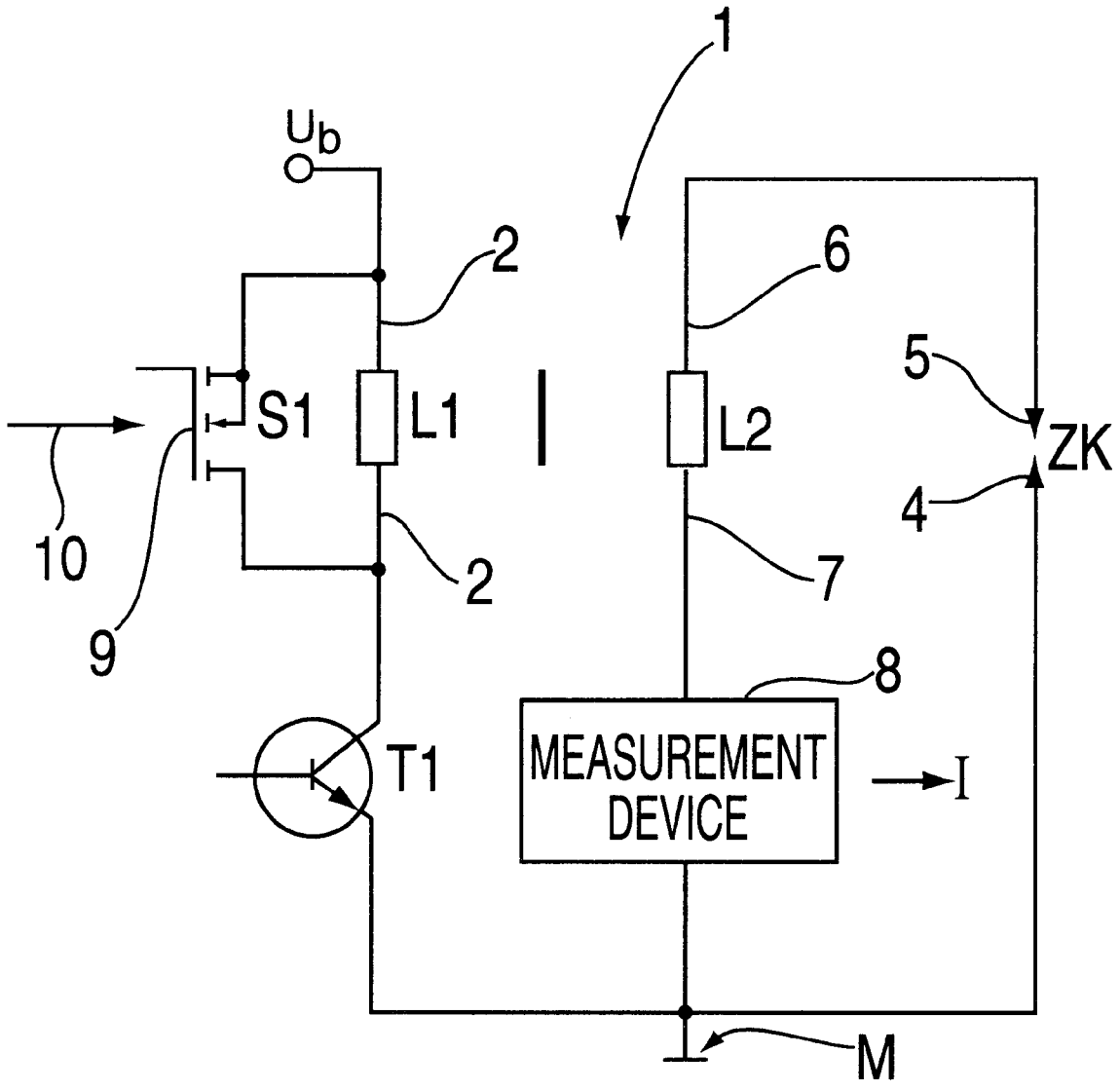
FIG. 1 shows a circuit diagram of an inductive ignition apparatus having an ionization current measurement device according to a first exemplary embodiment according to the present invention.

FIG. 1 shows an inductive ignition apparatus for a combustion engine (not depicted) according to the present invention. The ignition apparatus has an ignition coil device 1 that comprises a primary winding L1 and a secondary winding L2, which are magnetically coupled to one another. The one winding end 2 of primary winding L1 is connected to the operating voltage, i.e., battery voltage $U_b$ of a motor vehicle (not depicted) in which the combustion engine is installed. The other winding end 3 of primary winding L1 leads to the switch path of a transistor T1 which is activated by a control device (not depicted) in accordance with the desired ignition point. When transistor T1 is in the conductive state, winding end 3 can thus be connected to ground M (negative terminal of the battery delivering voltage $U_b$) via the collector-emitter path of transistor T1. A spark plug ZK, belonging to the combustion engine (not depicted), is connected with one of its electrodes 4 to ground M. The other electrode 5 of spark plug ZK is connected to one winding end 6 of secondary winding L2 of ignition coil device 1. The other winding end 7 of ignition coil device 1 leads to a measurement device 8 which measures an ionization current I. Measurement device 8 is also connected to ground M. The one winding end 2 of primary winding L1 of ignition coil device 1 is connected to one terminal of a switch S1. The other terminal of switch S1 leads to the other winding end 3 of primary winding L1. When switch S1 is closed, it is thus possible to short-circuit primary winding L1 of ignition coil device 1. Switch S1 is preferably configured as a field-effect transistor (FET), whose gate 9 can be activated by way of a control device (not depicted; indicated merely by an arrow 10) so that the aforementioned short-circuiting of primary winding L1 can be performed during desired time intervals. Corresponding activation of switch S1 thus makes it possible to short-circuit primary winding L1 of the carryover.

The manner of operation is thus as follows: Selected activation of the base of transistor T1 triggers a current flow in primary winding L1 of the ignition coil device, which results on the secondary side, i.e., in secondary winding L2, in the creation of a high voltage which causes triggering of an ignition spark at spark plug ZK. Once the combustion process has been initiated, spark plug ZK (functioning as a sensor) is then to be used to ascertain the ionization current in the combustion chamber of the combustion engine, so that conclusions can be drawn as to desired parameters. This is done by closing switch S1, causing the primary winding of the ignition coil device to be electrically short-circuited. The result is that the residual energy present in the magnetic circuit is dissipated, i.e., converted into heat energy. The ignition spark is thus extinguished in defined fashion and very quickly. At the same time, short-circuiting of the primary winding shifts the limit frequency of the secondary side of the ignition coil device considerably upward, so that the measurement can be made very accurately in the range relevant to knock vibrations, i.e., a particularly critical and undesirable operating state of the combustion engine can be sensed by measuring the ionization current. The result of the procedure according to the present invention, i.e., short-circuiting the primary winding for the entire duration of the ionization current measurement, is to achieve a spark duration at the spark plug which is so precise and short that ignition spark effects cannot in any circumstances impede subsequent measurement analysis or "mask" the measurement period. The short-circuiting according to the present invention also prevents the ignition system from decaying, i.e., ionization current measurement cannot be influenced by decay effects, which can result in incorrect interpretations. As already mentioned, the increase in the limit frequency resulting from short-circuiting of the primary winding overcomes the considerable band limiting which exists with conventional systems and which has previously interfered with sensitivity in the detection of undesirable operating states, for example knock vibrations (3 to 20 kHz). The present invention thus improves the previously poor signal transfer properties of the secondary winding through which the ionization current flows.

Figure 2:
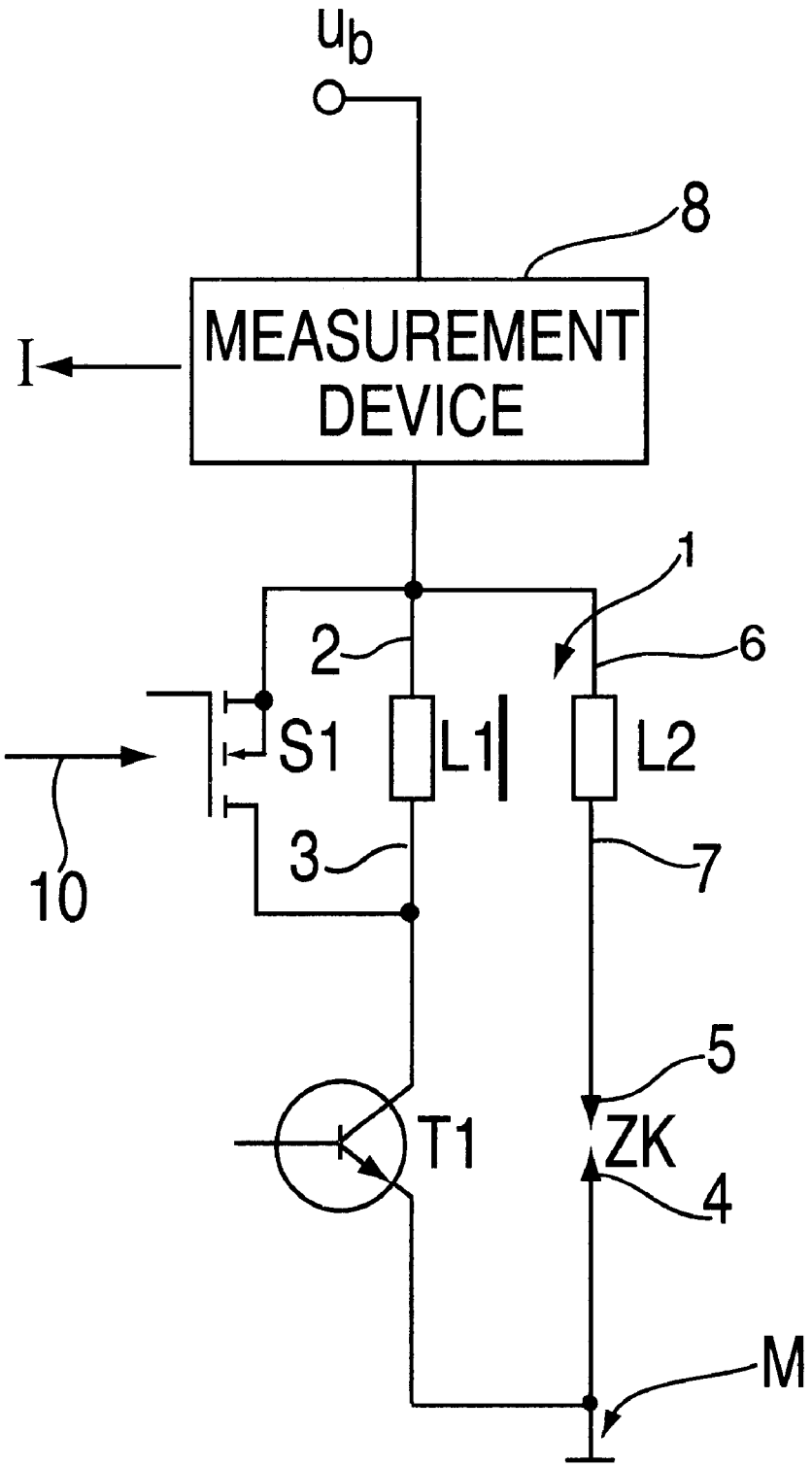
FIG. 2 shows a second exemplary embodiment of an inductive ignition apparatus having a measurement device for ascertaining the ionization current according to the present invention.

FIG. 2 shows, in accordance with the present invention, a further exemplary embodiment of an inductive ignition apparatus having a measurement device for ascertaining an ionization current, identical parts having been given reference characters identical to those in FIG. 1. The comments applicable to the exemplary embodiment of FIG. 2 are the same as those regarding the exemplary embodiment of FIG. 1, so that only the differences between these two exemplary embodiments will be discussed below.

Whereas in the exemplary embodiment of FIG. 1, analysis device 8 for measuring the ionization current is arranged in the secondary circuit of ignition coil device 1, in the exemplary embodiment of FIG. 2 it is located in the primary circuit; specifically, the positive terminal of battery voltage $U_b$ is connected to measurement device 8, and leads from there to the one winding end 2 of primary winding L1. The other winding end 3 of primary winding L1 is connected to the collector of transistor T1, whose emitter goes to ground M (negative terminal of battery voltage $U_b$). Electrode 4 of spark plug ZK is also connected to ground M. The other electrode 5 of spark plug ZK is connected to winding end 7 of secondary winding L2 of ignition coil device 1, and the other winding end 6 of secondary winding L2 is connected to winding end 2 of primary winding L1. Ignition coil device 1 is in that respect configured here as an autotransformer. Switch S1, once again preferably configured as a field-effect transistor (FET), is connected in parallel with primary winding L1, i.e., the one terminal of the switch path of switch S1 is connected to winding end 2, and the other terminal of switch S1 to winding end 3, of primary winding L1 of ignition coil device 1.

The manner of operation is thus as follows: Activation of transistor T1 into its conductive state causes a current to flow through primary winding L1 of ignition coil device 1, generating on the secondary side, i.e., in secondary winding L2, a high voltage which triggers an ignition spark in spark plug ZK. Once ignition of the fuel-air mixture in the combustion chamber of the combustion engine (not depicted) has occurred, switch S1 is closed by the control device (arrow 10); in other words, primary winding L1 of ignition coil device 1 is short-circuited. This is yields the advantages already cited with respect to the exemplary embodiment of FIG. 1, so that an optimum ionization current measurement can be performed using measurement device 8.

What is claimed is:

1. An inductive ignition apparatus for use in a combustion engine, the combustion engine including at least one cylinder, each cylinder having a spark plug, comprising:

at least one ignition coil device for forming an ignition high voltage, each ignition coil device coupled to a respective spark plug, the ignition coil device including a primary winding and a secondary winding, an ionization current flowing through the secondary winding;

a measurement device for ascertaining the ionization current at the spark plug of each cylinder, the measurement device being connected to one of the primary and the secondary winding; and a switch short-circuiting the primary winding for at least a duration of an ionization current measurement.

2. The inductive ignition apparatus according to claim 1, wherein the switch has a switch path, the switch path of the switch in a closed state having a very low resistance and exhibiting a low flux voltage.

3. The inductive ignition apparatus according to claim 1, wherein the switch includes a field-effect transistor (FET).

4. The inductive ignition apparatus according to claim 1, wherein the measurement device includes a control device, the control device closing the switch for at least the duration of the ionization current measurement.

5. The inductive ignition apparatus according to claim 4, wherein the control device closes the switch periodically.

* * * * *